US008104868B2

(12) United States Patent
Taira

(10) Patent No.: US 8,104,868 B2
(45) Date of Patent: Jan. 31, 2012

(54) LIQUID EJECTION APPARATUS

(75) Inventor: Hiroshi Taira, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 964 days.

(21) Appl. No.: 11/950,390

(22) Filed: Dec. 4, 2007

(65) Prior Publication Data

US 2008/0129776 A1 Jun. 5, 2008

(30) Foreign Application Priority Data

Dec. 5, 2006 (JP) ..... 2006-328373

(51) Int. Cl.
*B41J 2/165* (2006.01)

(52) U.S. Cl. ..... 347/33

(58) Field of Classification Search ..... 347/33
See application file for complete search history.

(56) References Cited

U.S. PATENT DOCUMENTS

| | | | | |
|---|---|---|---|---|
| 5,557,306 | A * | 9/1996 | Fukushima et al. | 347/33 |
| 5,612,722 | A * | 3/1997 | Francis et al. | 347/33 |
| 5,886,715 | A * | 3/1999 | Fukuoka | 347/33 |
| 6,578,945 | B2 * | 6/2003 | Hashi et al. | 347/22 |
| 6,609,780 | B2 * | 8/2003 | Sugiyama | 347/33 |
| 7,175,254 | B2 | 2/2007 | Tsukada | |
| 7,571,980 | B2 * | 8/2009 | Deshon-Stepp et al. | 347/30 |
| 2002/0005874 | A1 * | 1/2002 | Imai et al. | 347/33 |
| 2002/0044168 | A1 | 4/2002 | Hashi et al. | |
| 2005/0078146 | A1 * | 4/2005 | Sakurai | 347/33 |
| 2005/0104925 | A1 * | 5/2005 | Kimura | 347/33 |
| 2006/0066663 | A1 * | 3/2006 | Takagi | 347/33 |
| 2009/0073219 | A1 * | 3/2009 | Curcio et al. | 347/33 |

FOREIGN PATENT DOCUMENTS

| | | | |
|---|---|---|---|
| JP | H07-096604 | A | 4/1995 |
| JP | 2001-030514 | A | 2/2001 |
| JP | 2002-120386 | A | 4/2002 |
| JP | 2003-136743 | A | 5/2003 |
| JP | 2004074774 | A | 3/2004 |
| JP | 2005-022200 | A | 1/2005 |

OTHER PUBLICATIONS

Japanese Patent Office, Office Action for Japanese Application No. 2006-328373, date Nov. 25, 2008.

Japan Patent Office; Notice of Reasons for Rejection in Japanese Patent Application No. 2006-328373 (counterpart to the above-captioned U.S. patent application) mailed Apr. 7, 2009.

* cited by examiner

*Primary Examiner* — Charlie Peng
(74) *Attorney, Agent, or Firm* — Baker Botts L.L.P.

(57) ABSTRACT

A liquid ejection apparatus includes a wiper, first and second movement mechanisms, and a controller. The wiper wipes an ejection face of a head. The controller controls the first movement mechanism to make at least either one of the wiper and the head move in a first direction perpendicular to the ejection face, so as to make the wiper and the head overlap each other with respect to the first direction. And thereafter the controller controls the second movement mechanism to make the wiper perform a first wiping. In the first wiping, while liquid is forcibly ejected from the ejection face, the wiper moves along the ejection face while being in contact with the ejection face.

6 Claims, 7 Drawing Sheets

LIQUID EJECTION APPARATUS

CROSS REFERENCE TO RELATED APPLICATION

The present application claims priority from Japanese Patent Application No. 2006-328373, which was filed on Dec. 5, 2006, the disclosure of which is herein incorporated by reference in its entirety.

BACKGROUND OF THE INVENTION

1. Field of the Invention

The present invention relates to a liquid ejection apparatus including a head which ejects liquid.

2. Description of Related Art

A liquid ejection apparatus is known including a recording head which is formed with a plurality of ink ejecting nozzles, and a wiper which wipes a face of the recording head formed with nozzle openings, that is, an ink ejection face, to thereby remove deposits adhering to the ink ejection face such as ink, paper dust, ink containing paper dust, and the like (see Japanese Unexamined Patent Publication No. 2004-74774). In the apparatus, a suction pump is driven while a cap is covering the ink ejection face, to produce negative pressure in the cap so that ink is forcibly ejected from the nozzle. Then, a wiping is performed using a wiper which is made of an elastic material such as rubber. More specifically, the wiper is moved relative to the recording head while kept in contact with the ink ejection face, thereby removing ink or the like adhering to nozzle openings and therearound from the ink ejection face.

SUMMARY OF THE INVENTION

In the above-mentioned apparatus, during the wiping, deposits on the ink ejection face are dragged by the wiper, and further may go into the nozzles because of pressing force of the wiper to the ink ejection face. This may cause a problem that characteristics of ink ejection from the nozzles are disturbed.

An object of the present invention is to provide a liquid ejection apparatus which makes it difficult for deposits adhering to an ejection face to enter an ejection opening during a wiping.

According to an aspect of the present invention, there is provided a liquid ejection apparatus comprising a head, a wiper, a supplier, a first movement mechanism, a second movement mechanism, and a controller. The head has an ejection face on which a plurality of ejection openings through which liquid is ejected are formed. The wiper wipes the ejection face. The supplier supplies liquid to the head so that liquid is forcibly ejected from the ejection openings. The first movement mechanism moves at least either one of the wiper and the head in a first direction which is perpendicular to the ejection face, so as to make the wiper and the head overlap each other with respect to the first direction. The second movement mechanism moves at least either one of the wiper and the head, so as to make the wiper move along the ejection face while being in contact with the ejection face. The controller controls the supplier to make liquid forcibly ejected from the ejection openings. The controller further controls the first movement mechanism to make at least either one of the wiper and the head move in the first direction, and thereafter controls the second movement mechanism to make the wiper perform a first wiping. In the first wiping, while liquid is forcibly ejected from the ejection openings, the wiper moves along the ejection face while being in contact with the ejection face.

In the aspect, while liquid is being forcibly ejected from the ejection openings, the wiper wipes the ejection face. This makes it difficult for deposits on the ejection face to enter the ejection openings. As a result, characteristics of liquid ejection from the ejection openings are stabilized.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

In the following, a certain preferred embodiment of the present invention will be described with reference to the accompanying drawings.

Figure 1:
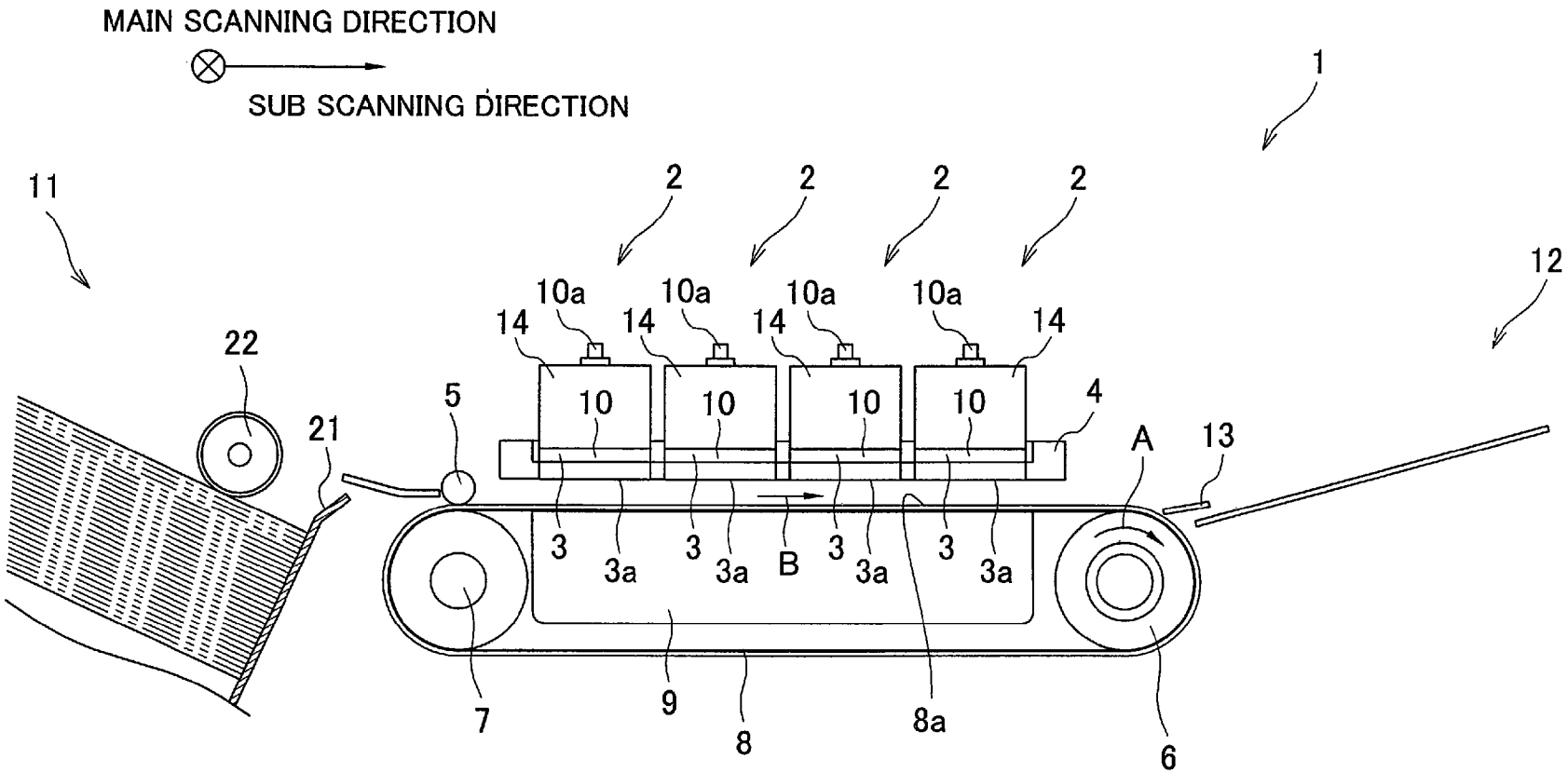
FIG. 1 is a schematic side sectional view of an ink-jet printer according to an embodiment of the present invention.

As shown in FIG. 1, an ink-jet printer 1 according to an embodiment of the present invention is a color ink-jet printer including four ink-jet heads 2 which eject magenta ink, cyan ink, yellow ink, and black ink, respectively. The ink-jet printer 1 includes a paper feed unit 11 and a paper discharge unit 12, which are shown in left and right parts of FIG. 1, respectively.

Formed within the ink-jet printer 1 is a paper conveyance path through which a paper as a recording medium is conveyed from the paper feed unit 11 toward the paper discharge unit 12. The paper feed unit 11 has a paper tray 21 and a pick-up roller 22. The pick-up roller 22 sends out an uppermost one of papers accommodated in the paper tray 21. When the pick-up roller 22 is rotated by driving of a pick-up motor 132 (see FIG. 4), a paper is sent from left to right in FIG. 1. Two belt rollers 6 and 7, and an endless conveyor belt 8 are disposed between the paper feed unit 11 and the paper discharge unit 12. The endless conveyor belt 8 is wound on the rollers 6 and 7 so as to be stretched between the rollers 6 and 7. By driving of a conveyor motor 133 (see FIG. 4), the belt roller 6 is rotated clockwise as indicated by an arrow A in FIG. 1. A pressing roller 5 is disposed immediately downstream of the paper feed unit 11, at a position opposed to the belt roller 7 with the conveyor belt 8 sandwiched therebetween. The pressing roller 5 presses a paper, which has been sent out from the paper feed unit 11, onto a conveyor face 8*a* of the conveyor belt 8. The conveyor face 8*a* of the conveyor belt 8 has adhesiveness. Therefore, the paper is, while being held on the conveyor face 8*a* by adhesive force of the conveyor face 8*a*, conveyed in a conveyance direction as indicated by an arrow B in FIG. 1.

A peeling member 13 is provided immediately downstream of the conveyor belt 8 in the paper conveyance path. The peeling member 13 peels a paper, which has been held on the conveyor face 8*a* of the conveyor belt 8, from the conveyor face 8*a*, and then guides the paper P to the paper discharge unit 12.

A platen 9 having a substantially rectangular parallelepiped shape is disposed within a region enclosed by the conveyor belt 8, so as to be opposed to the four ink-jet heads 2. The platen 9 is in contact with a lower face of an upper part of a loop of the conveyor belt 8, to thereby support it from an inside, so that a later-described ejection face 3*a* of each ink-jet head 2 and the conveyor face 8*a* of the conveyor belt 8 are kept at a constant interval.

Figure 2:
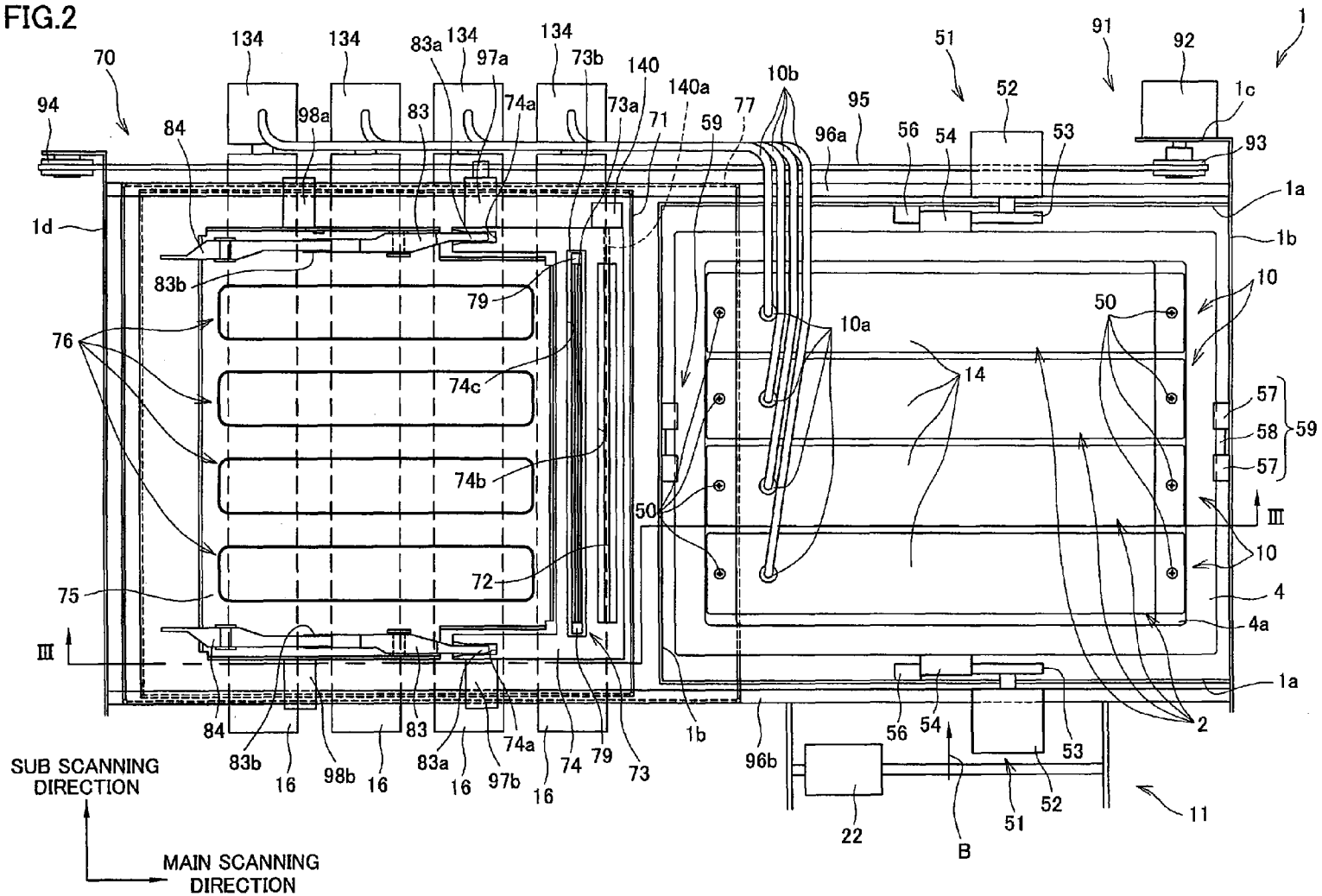
FIG. 2 is a schematic plan view showing an essential part of the ink-jet printer.
Figure 3:
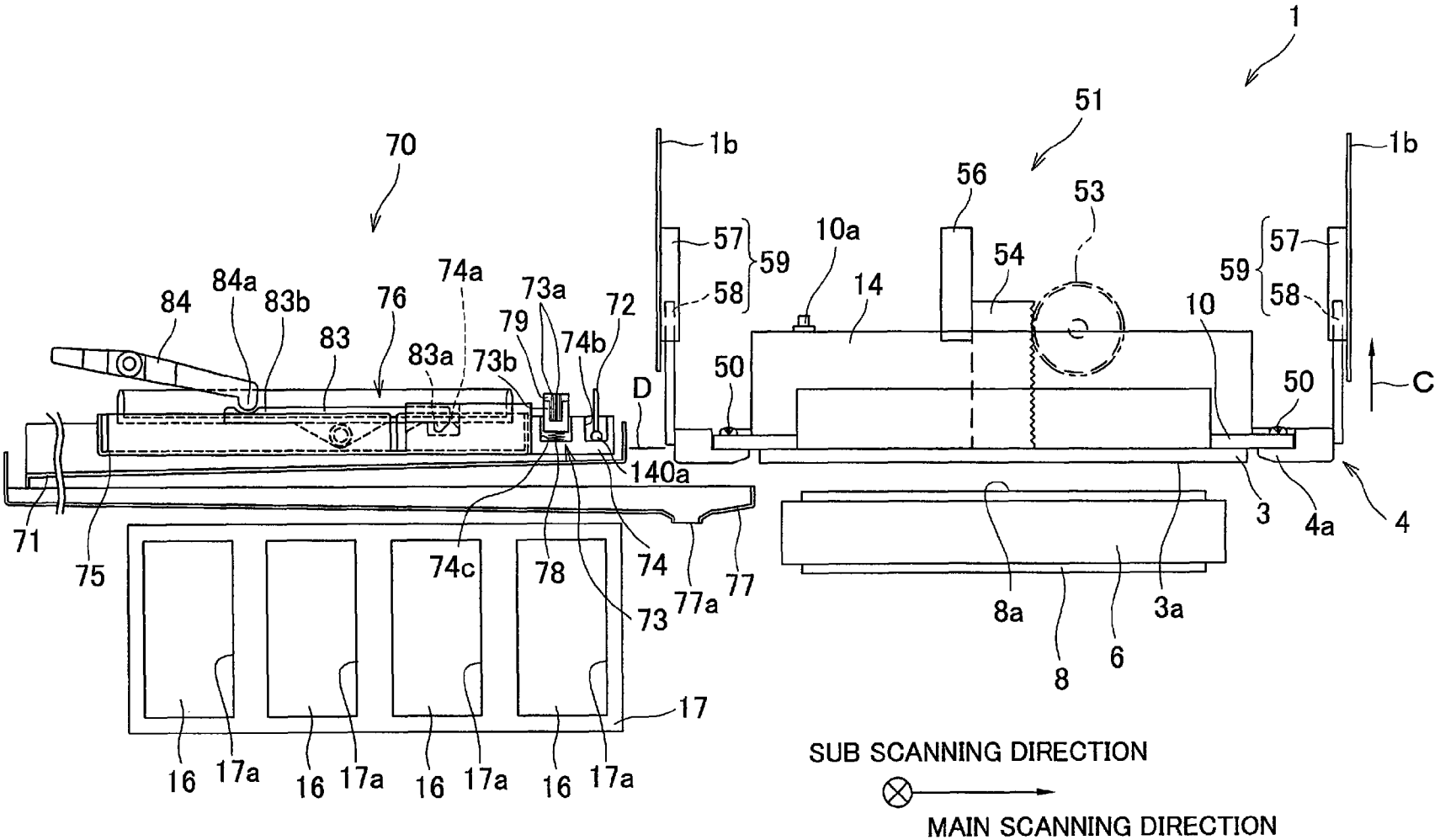
FIG. 3 is a sectional view as taken along line III-III shown in FIG. 2.

As shown in FIG. 2, each of the ink-jet heads 2 extends in a main scanning direction (which is perpendicular to the conveyance direction B and also to a plane defined by the drawing sheet of FIG. 1). The ink-jet heads 2 are arranged side by side in a sub scanning direction (which is along the conveyance direction B). That is, the ink-jet printer 1 is a line-type printer. As shown in FIGS. 1 and 3, the ink-jet head 2 has a head main body 3 at its lower end. The head main body 3 is made up of a passage unit and an actuator being attached to each other. In the passage unit, ink passages including pressure chambers are formed. The actuator applies pressure to ink contained in the pressure chambers. The head main body 3 has a rectangular parallelepiped shape elongated in the main scanning direction.

As shown in FIGS. 1 and 3, a reservoir unit 10 which temporarily stores ink therein is fixed to an upper face of the head main body 3. The reservoir unit 10 is partially covered by a cover 14, and connected to a tube joint 10*a* which is fixed to an upper face of the cover 14. Formed within the reservoir unit 10 is an ink reservoir in which ink supplied from the tube join 10*a* is stored. The reservoir unit 10 is longer than the head main body 3, and protrudes beyond both lengthwise ends of the head main body 3. A frame 4 is fixed to protruding portions of the reservoir unit 10. In a bottom face of the head main body 3, that is, in an ejection face 3*a*, a plurality of small-diameter nozzles are formed and arranged.

As shown in FIG. 2, one end of a flexible tube 10*b* is connected to the tube joint 10*a*. The other end of the tube 10*b* is connected to a pump 134 which is provided corresponding to each of four ink cartridges 16. The pump 134 allows ink to circulate therein. The pump 134 and the tube 10*b* constitute an ink supply passage extending from the ink cartridge 16 to the ink-jet head 2. In a printing, ink contained in the ink cartridge 16 goes through the ink supply passage, to be supplied to the head main body 3. When ink is initially introduced into the ink-jet heads 2 and when a purge is performed, the pumps 134 are driven to forcibly send ink contained in the ink cartridges 16 to the head main bodies 3 via the ink supply passage. When ink is initially introduced into the ink-jet head 2, as compared with when a purge is performed, the pump 134 is kept driven for a longer period, because the ink passages formed in the head main body 3 have to be filled with ink.

As shown in FIG. 3, the ink cartridge 16 is mounted on a cartridge mounting 17 which is provided below a standby position of the maintenance unit 70. The cartridge mounting 17 has four openings 17*a* which are shown opened on this side in FIG. 3. The opening 17*a* has a substantially rectangular shape. The openings 17*a* are arranged side by side along the main scanning direction. The ink cartridges 16 are, by being mounted to the respective openings 17*a*, connected to the pumps 134, so that ink contained in the ink cartridges 16 circulates into the pumps 134.

The head main body 3 is disposed in such a manner that the ejection face 3*a* and the conveyor face 8*a* of the conveyor belt 8 are opposed to and parallel with each other with a narrow gap formed between these faces 3*a* and 8*a*. The gap forms a part of the paper conveyance path. At a time when a paper, which is conveyed while being held on the conveyor face 8*a* of the conveyor belt 8, is passing just under the four head main bodies 3 sequentially, ink of the respective colors is ejected toward an upper face of the paper, that is, toward a printing face of the paper, thereby forming a desired color image on the paper.

As shown in FIG. 2, the ink-jet heads 2 are fixed to the frame 4 so as to be adjacent to each other in the sub scanning direction. As shown in FIG. 3, the frame 4 has a supporter 4*a* which supports the reservoir unit 10 from a lower side thereof. The supporter 4*a* protrudes inward up to such a point that the supporter 4*a* is opposed to both lengthwise ends of the reservoir unit 10. The supporter 4*a* and the lengthwise ends of the reservoir unit 10 are fixed to each other with screws 50. The ejection face 3*a* is substantially at the same level as a bottom face of the frame 4, and exposed in its lower part through an opening of the frame 4.

As shown in FIGS. 2 and 3, the frame 4 is supported on a pair of frame movement mechanisms 51 which is provided in the printer 1, in such a manner that the frame 4 is movable in a vertical direction. As shown in FIG. 2, the pair of frame movement mechanisms 51 are disposed on both sides of a set of the four ink-jet heads 2 with respect to the sub scanning direction. Each of the frame movement mechanisms 51 includes a head motor 52 which is a drive source for moving the frame 4 in the vertical direction, a pinion gear 53 which is fixed to a shaft of the head motor 52, a rack gear 54 which is engaged with the pinion gear 53, and a guide 56 which is positioned in such a manner that the rack gear 54 is sandwiched between the guide 56 and the pinion gear 53.

The head motors 52 included in the pair of frame movement mechanisms 51 are fixed to a pair of main body frames 1*a* of the ink-jet printer 1, respectively. The pair of main body frames 1*a* are disposed in such a manner that they are opposed to each other with respect to the sub scanning direction. The rack gear 54 extends in the vertical direction, and a lower end of the rack gear 54 is fixed to a side face of the frame 4. A side face of the rack gear 54 facing opposite to the pinion gear 53 is in slidable contact with the guide 56. The guide 56 is fixed to the main body frame 1*a*.

When the two head motors 52 are synchronized to rotate the pinion gear 53 in normal and reverse directions, the rack gear 54 moves upward or downward. In association with movement of the rack gear 54, the frame 4 and the ink-jet heads 2 moves in the vertical direction.

A pair of guide units 59 is provided at both sides of the frame 4 extending along the sub scanning direction. Each of the guide units 59 includes a bar 58 and a pair of guides 57 which sandwiches the bar 58 therebetween. As shown in FIG. 3, the pair of guides 57 extend in the vertical direction, and fixed to the pair of main body frames 1*b* of the ink-jet printer 1, respectively. The pair of main body frame 1*b* are opposed to each other with respect to the main scanning direction. The bar 58 extends in the vertical direction similarly to the guide 57 and is, at the aforesaid side of the frame 4, fixed to a side face of the frame 4 opposed to the main body frame 1*b*. The bar 58 is in slidable contact with each of the pair of guides 57.

While the ink-jet heads 2 perform a printing on a paper, the frame 4 is in a printing position as shown in FIG. 3. When ink is initially introduced into the heads 2 and when a maintenance of the heads 2 is performed, the frame 4 is moved to a position above the printing position by the frame movement mechanisms 51.

In this embodiment, a maintenance includes a purge, a wiping, and a capping. The purge is to forcibly eject ink from the nozzles of the ink-jet heads 2. The wiping is to wipe the ejection faces 3*a*. The capping is to cover the ejection faces 3*a* with caps. The purge is performed, immediately after ink is initially introduced into the ink-jet heads 2, when a maintenance command is received from a PC (Personal Computer) 100 (see FIG. 4), and when the number of printed pages reaches a predetermined value. The purge includes first and second purges which will be described later. The maintenance command is transmitted from the PC 100 when, for example, a user visually observes a failure of recording and operates the PC 100. By performing a purge, clogging of nozzles or ink thickening within the nozzles, which is caused in the ink-jet heads 2, can be removed so that ejection characteristics are recovered. Ink ejection performed in the purge is not splashing ink from the nozzles but oozing ink from the nozzles. The wiping is performed by a wiper 72 and an ink receiving member 73 which will be described later. The wiping includes a first wiping which is performed subsequent to the first purge, and a second wiping which is performed subsequent to the second purge, as will be detailed later. The capping is performed for the purpose of preventing ink contained in the nozzles from drying up, in a case where the printer 1 does not perform a printing for a long time, and the like.

Next, a maintenance unit 70 which performs a maintenance of the ink-jet heads 2 will be described. Except when ink is initially introduced into the heads 2 and when a maintenance is performed, for example while a printing is performed, the maintenance unit 70 is disposed in a standby position which is not opposed to the ink-jet heads 2 with respect to the vertical direction, as shown in FIGS. 2 and 3. In FIG. 1, the standby position is located behind the ink-jet heads 2. The maintenance unit 70 has two horizontally-movable trays 71 and 75. The tray 71 has a box-like shape which is substantially square in a plan view and opened on its upper side. The tray 71 contains the tray 75 therein. The trays 71 and 75 are attached to and detached from each other by engagement and disengagement between a pair of protrusions 83*a* and a pair of recesses 74*a* which are switched from one to the other depending on contents of the maintenance.

A side face of the tray 71 distant from the ink-jet heads 2 (which is a left side face thereof in FIG. 3) is opened. For example, when initially introducing ink and when performing a purge, the trays 71 and 75 are disengaged, and only the tray 71 moves with the tray 75 being left. Before the maintenance unit 70 horizontally moves from the standby position to a maintenance position which will be described later, the frame 4 in advance moves from the printing position upward along a direction indicated by an arrow C in FIG. 3, irrespectively of whether the recesses 74 and the protrusions 83*a* are engaged with each other or not. Thereby, a space for the maintenance unit 70 to be placed is ensured between the ejection faces 3*a* and the conveyor face 8*a*. Then, the maintenance unit 70 moves horizontally along a direction indicated by an arrow D, into a maintenance position which is opposed to the ejection faces 3*a*.

Figure 5A:
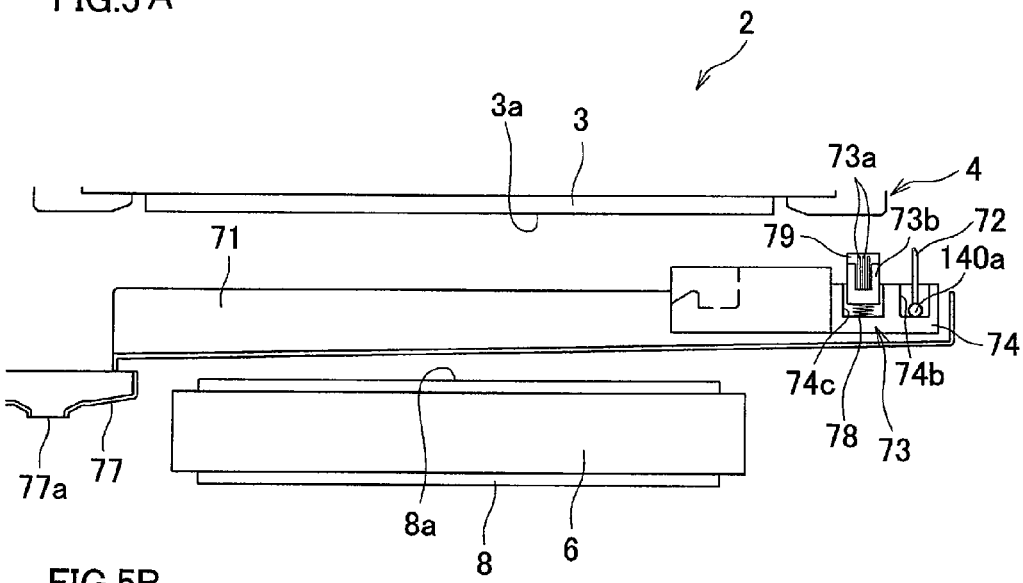
FIGS. 5A, 5B, and 5C are schematic side views showing a process of a first wiping.

A waste ink tray 77 is provided above the cartridge mounting 17 and immediately below the standby position of the maintenance unit 70. A bottom face of the tray 77 slopes down toward a direction opposite to the arrow-D direction, so that ink having flown into the tray 71 moves along this slope and is received by the waste ink tray 77. The waste ink tray 77 has such a size as to contain the tray 71 therein in a plan view, and such a shape as to, with respect to the vertical direction, overlap an edge of the tray 71 corresponding to the opened side face when the tray 71 is in the maintenance position, as shown in FIG. 5A. An ink discharge hole 77*a* which is formed through a bottom face of the waste ink tray 77 is provided in the vicinity of an end of the waste ink tray 77 near the ink-jet heads 2. Ink received by the waste ink tray 77 goes through the ink discharge hole 77*a* and flows into a waste ink reservoir (not shown).

Figure 7A:
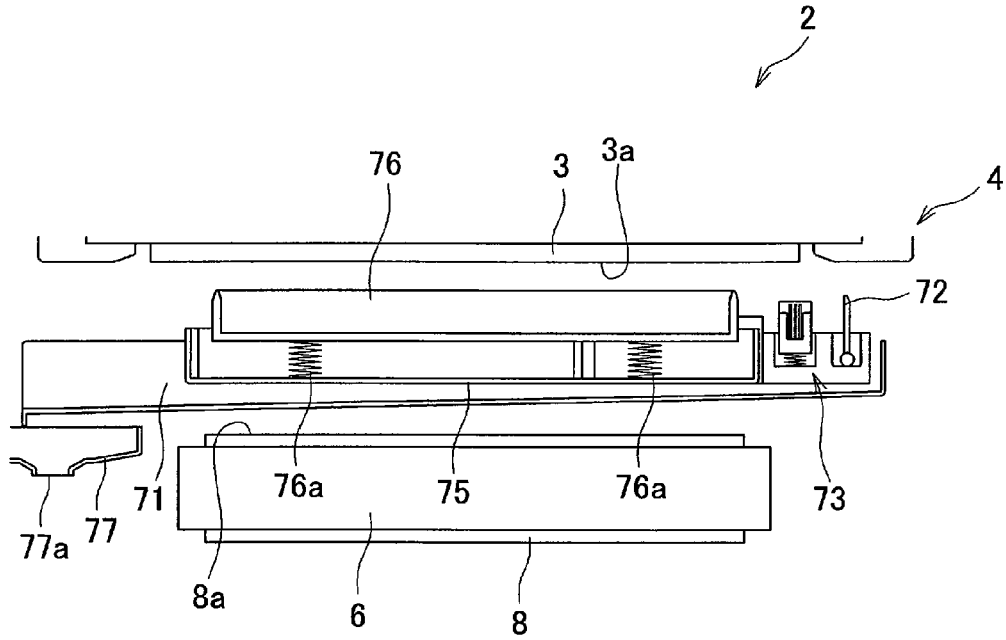
FIGS. 7A and 7B are schematic side views showing a process of a capping.
Figure 7B:
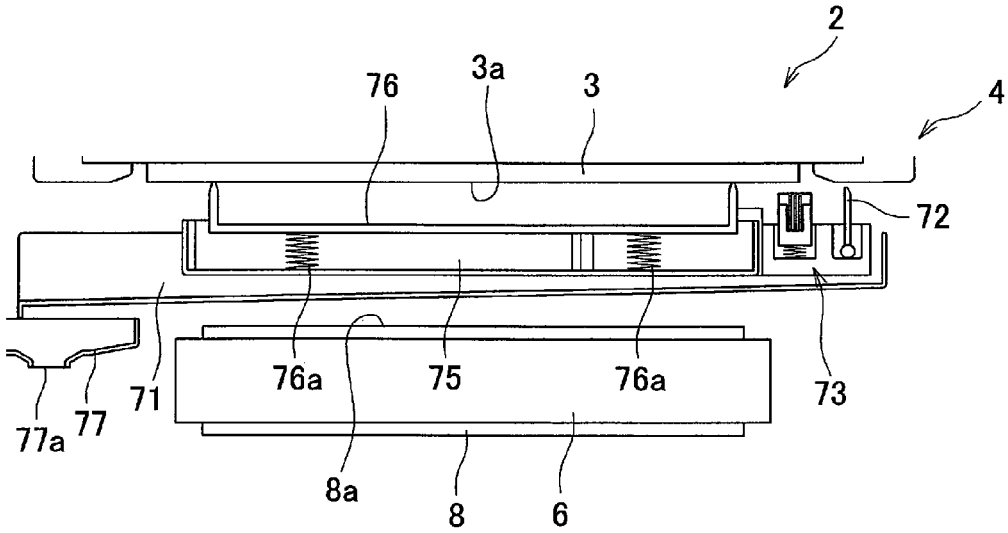

Disposed within the tray 71 are a wiper 72, an ink receiving member 73, and the tray 75 in this order from the one nearest the ink-jet heads 2 when in the standby position as shown in FIGS. 2 and 3. As shown in FIG. 2, four caps 76 which correspond to the respective ink-jet heads 2 are provided within the tray 75. The four caps 76 are disposed at the same pitches as the ink-jet heads 2 are disposed at with respect to the sub scanning direction. Each of the caps 76 has a rectangular shape elongated in the main scanning direction in a plan view, and a box-like shape with its upper side opened. In performing a capping, the cap 76 comes into contact with the ejection face 3*a* and thereby forms a sealed space with its recess as shown in FIG. 7B, thus preventing ink contained in the nozzles from drying up. The cap 76 is biased upward by a spring 76*a* (see FIGS. 7A and 7B).

As shown in FIGS. 2 and 3, a holding member 74 which holds the wiper 72 and the ink receiving member 73 are fixed to the tray 71. As shown in FIG. 2, the holding member 74 has a U shape in a plan view, and holds the wiper 72 and the ink receiving member 73 by its portions extending along the sub scanning direction. Recesses 74*a* are formed at respective ends of two portions of the holding member 74 extending along the main scanning direction.

As shown in FIGS. 2 and 3, a recess 74*b* opened on its upper side is formed at a portion of the holding member 74 which holds the wiper 72. In a plan view, an opening of the recess 74*b* has a rectangular shape elongated in the sub scanning direction. On a bottom face of the recess 74*b*, a drive shaft 140*a* of a wiper motor 140 is disposed so as to extend along the sub scanning direction. The wiper motor 140 is fixed to a side face of the holding member 74. The wiper 72 is fixed to the drive shaft 140*a* so as to protrude upward from the opening of the recess 74*b*. As the wiper motor 140 is driven so that the drive shaft 140*a* is rotated slightly in normal and reverse directions, the wiper 72 selectively takes any one of a first state where the wiper 72 extends in the vertical direction when viewed in the sub scanning direction, a second state where the wiper 72 is inclined away from the vertical direction toward a wiping direction when viewed in the sub scanning direction, and a third state where the wiper 72 is inclined away from the vertical direction toward a direction opposite to the wiping direction when viewed in the sub scanning direction. The wiping direction means a direction in which the wiper 72 moves during a wiping. The wiper motor 140 and the drive shaft 140*a* constitute a swing mechanism which swings the wiper 72.

As shown in FIG. 2, the wiper 72 extends along the sub scanning direction, and has a length slightly larger than a width of the set of four ink-jet heads 2 arranged side by side. The wiper 72 is made of an elastic material such as rubber. In the standby position, the wiper 72 is disposed with its plate surface extending perpendicularly to the main scanning direction, as shown in FIG. 3.

As shown in FIGS. 2 and 3, a recess 74*c* opened on its upper side is formed in a portion of the holding member 74 which holds the ink receiving member 73. In a plan view, like the opening of the recess 74*b*, an opening of the recess 74*c* has a rectangular shape elongated in the sub scanning direction. A length of the opening of the recess 74*c* is larger than the length of the opening of the recess 74*b*.

The ink receiving member 73 has a holder 73*b* and three thin plates 73*a* made of stainless steel. The holder 73*b* extends along the sub scanning direction, and is slightly longer than the wiper 72. In a cross-sectional view, the holder 73*b* has a U-like shape with its upper side opened. The thin plates 73*a* is standingly provided on a bottom face of the holder 73*b*. The thin plates 73*a* are disposed in parallel with each other along the sub scanning direction, and at intervals corresponding to capillary force on ink with respect to the main scanning direction. A length of the thin plate 73*a* extending along the sub scanning direction is the same as the holder 73*b*. The holder 73*b* is biased by a spring 78 which is provided on a lower face of the holder 73*b*. The holder 73*b* and the thin plates 73*a* protrude upward from the opening of the recess 74*c*.

The ink receiving member 73 further has a pair of protrusions 79 which are provided at respective lengthwise ends of the holder 73*b*. Upper faces of the protrusions 79 are located above distal ends of the thin plates 73*a* by approximately 0.5 mm. During a wiping, the upper faces of the pair of protrusions 79 are kept in contact with respective bottom faces of both sides of the frame 4 with respect to the main scanning direction (see FIGS. 5B and 5C, and FIGS. 6B and 6C, for example). Accordingly, the distal ends of the thin plates 73*a* and the ejection faces 3*a* are kept at a constant distance of approximately 0.5 mm. In the wiping, the three thin plates 73*a* receive ink adhering to the ejection faces 3*a*, not by coming into contact with the ejection faces 3*a* but by the capillary force. The upper faces of the protrusions 79 are always located lower than a distal end of the wiper 72.

The trays 71 and 75 are attached to or detached from each other by engagement or disengagement of the pair of protrusions 83*a* formed in hooks 83 with or from the pair of recesses 74*a* formed in the holding member 74. As shown in FIG. 2, a set of the recess 74*a* and the protrusion 83*a* is provided near each side of the tray 71 and 75 extending along the main scanning direction. The hook 83 extends along the main scanning direction, and rotatably supported at a center thereof. The protrusion 83*a* is formed at an end of the hook 83 closer to the wiper 72. Two contact members 84 corresponding to the respective hooks 83 are provided in a rotatable manner. When the contact member 84 rotates clockwise in FIG. 3, a protrusion 84*a* formed at a distal end of the contact member 84 comes into contact with an end portion 83*b* of the hook 83 and presses down the end portion 83*b*. The hook 83 accordingly rotates counterclockwise in FIG. 3, so that the recess 74*a* and the protrusion 83*a* are disengaged from each other. On the other hand, when the contact member 84 rotates counterclockwise in FIG. 3, the hook 83 rotates clockwise in FIG. 3. When the contact member 84 becomes separated from the end portion 83*b* of the hook 83, the protrusion 83*a* becomes engaged with the recess 74*a*. Thus, a state returns to a state shown in FIG. 3.

When ink is initially introduced into the heads 2 and when a maintenance is performed, the maintenance unit 70 moves horizontally along the arrow-D direction from the standby position as shown in FIG. 3 into the maintenance position opposed to the ejection faces 3*a*. At this time, a location of the ink-jet heads 2 is above a location of the maintenance unit 70 disposed in the maintenance position so as to prevent the ejection faces 3*a* from being in contact with the wiper 72 and the caps 76.

When ink is initially introduced and when a purge is performed, the tray 75 is left, and the tray 71 alone moves from the standby position into the maintenance position to receive ink ejected from the heads 2. When a capping is performed, the trays 71 and 75, while being coupled to each other by engagement of the recess 74*a* and the protrusion 83*a*, move horizontally from the standby position and stop in the capping position which makes the caps 76 opposed to the ejection faces 3*a* as shown in FIG. 7A.

As shown in FIG. 2, the trays 71 and 75 are movably supported on a pair of guide shafts 96*a* and 96*b* which extend in the main scanning direction. Each of the pair of guide shafts 96*a* and 96*b* has their both ends fixed to a main body frame 1*b* which is located rightmost in FIG. 2 and a main body frame 1*d* which is located leftmost in FIG. 2, respectively. The pair of guide shafts 96*a* and 96*b* are disposed between the frames 1*b* and 1*d* so as to extend in parallel with each other. Two bearing members 97*a* and 97*b* are provided on the tray 71. Each of the bearing members 97*a* and 97*b* protrudes outward from an end of each of two portions of the holding member 74 extending in the main scanning direction. On side faces of the tray 75 extending along the main scanning direction, bearing members 98*a* and 98*b* protrude, respectively. Along the guide shafts 96*a* and 96*b*, the trays 71 and 75 move in the main scanning direction.

Here, a description will be given to a horizontal movement mechanism 91 which moves the trays 71 and 75 in a horizontal direction. As shown in FIG. 2, the horizontal movement mechanism 91 has a tray motor 92, a motor pulley 93, an idler pulley 94, a timing belt 95, and the guide shafts 96*a* and 96*b*. The tray motor 92 is fixed to an attacher 1*c* with a screw or the like. The attacher 1*c* is provided at an end portion of the main body frame 1*b* which extends in parallel with the sub scanning direction. The motor pulley 93 is connected to the tray motor 92, and rotates along with driving of the tray motor 92. The idler pulley 94 is rotatably supported on the main-body frame 1*d* which is located leftmost in FIG. 2. The timing belt 95 extends in parallel with the guide shaft 96*a*, and wound on the motor pulley 93 and the idler pulley 94 to be stretched between them. The bearing member 97*a* is connected to the timing belt 95.

Driving the tray motor 92 causes the motor pulley 93 to rotate in a normal or reverse direction and thus the timing belt 95 travels. Consequently, the tray 71 which is connected to the timing belt 95 via the bearing member 97*a* horizontally moves leftward or rightward in FIG. 2 toward the standby position or the maintenance position. When the recess 74*a* and the protrusion 83*a* are engaged with each other, the trays 71 and 75 move together, in other words, the wiper 72 and the ink receiving member 73 fixed on the tray 71 and the caps 76 fixed on the tray 75 move together. When the recess 74*a* and the protrusion 83*a* are disengaged from each other, only the tray 71 moves, in other words, only the wiper 72 and the ink receiving member 74 fixed on the tray 71 move.

Figure 4:
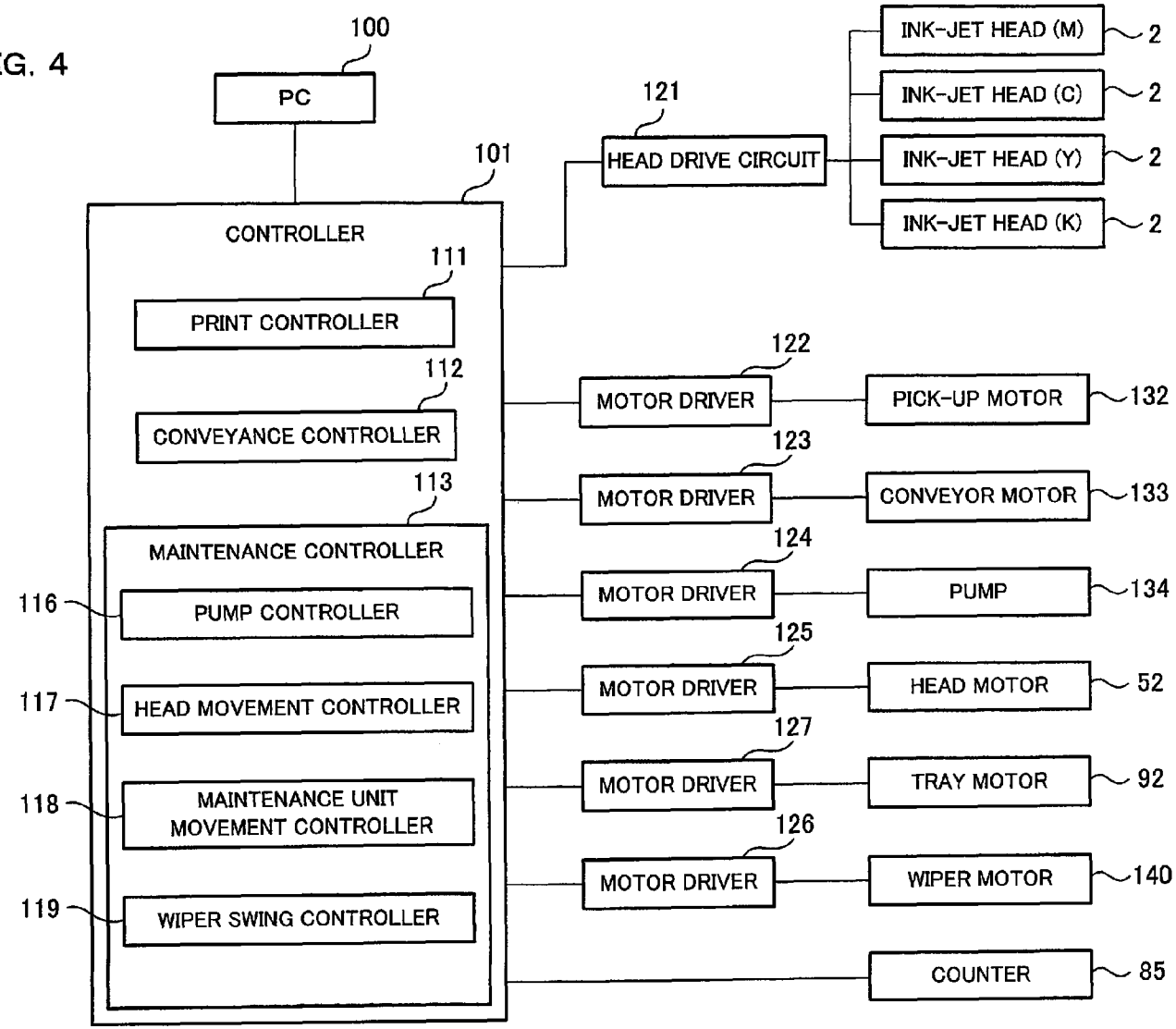
FIG. 4 is a block diagram showing an electrical construction of the ink-jet printer.

Next, an electrical construction of the ink-jet printer 1 will be described with reference to FIG. 4. The ink-jet printer 1 has a controller 101 that controls operations of the printer 1. The controller 101 includes a CPU (Central Processing Unit) which is an arithmetic processor, a ROM (Read Only Memory) which stores therein a control program executed by the CPU and data used for the control program, and a RAM (Random Access Memory) which temporarily stores therein data during execution of a program. From these parts, a head controller 111, a conveyance controller 112, a purge controller 113, and a covering controller 114 shown in FIG. 9 are constructed. The controller 101 includes a print controller 111, a conveyance controller 112, and a maintenance controller 113. A counter 85 which counts the number of papers subjected to a printing by the heads 2 is connected to the controller 101. When the number counted by the counter 85 reaches a predetermined value, the controller 101 transmits to the counter 85 a reset signal which sets the number of counts to zero.

Based on print data received from the PC 100, the print controller 111 controls a head drive circuit 121 so as to make ink ejected from the corresponding ink-jet head 2. When the number counted by the counter 85 reaches the predetermined value, the print controller 111 controls the head drive circuit 121 so as to stop ink ejection from the corresponding ink-jet head 2.

When print data are received from the PC 100, the conveyance controller 112 controls a motor driver 122 so as to drive a pick-up motor 132 thereby rotating the pick-up roller 22 so that a paper accommodated in the paper tray 21 is sent out onto the conveyor belt 8, and at the same time the conveyance controller 112 controls a motor driver 123 so as to drive a conveyor motor 133 thereby rotating the belt roller 6 so that the paper is conveyed while being held on the conveyor face 8*a* of the conveyor belt 8. When the number counted by the counter 85 reaches the predetermined value, the conveyance controller 112 controls the motor driver 122 so as to stop driving of the pick-up motor 132 thereby stopping rotation of the pick-up roller 22, and at the same time the conveyance controller 112 controls the motor driver 123 so as to stop driving of the conveyor motor 133 thereby stop rotation of the belt roller 6 after the paper held on the conveyor belt 8 reaches the paper discharge unit 12.

The maintenance controller 113 includes a pump controller 116, a head movement controller 117, a maintenance unit movement controller 118, and a wiper swing controller 119.

When ink is initially introduced into the heads 2 and when a purge is performed, the pump controller 116 controls a pump driver 124 so as to drive the pumps 134 to forcibly send ink contained in the ink cartridges 16 to the head main bodies 3.

When ink is initially introduced into the heads 2 and when a maintenance of the heads 2 is performed, the head movement controller 117 controls a motor driver 125 so as to drive the head motor 52 to move the ink-jet heads 2 upward from the print position. After a maintenance of the heads 2 is completed, the head movement controller 117 controls the motor driver 125 so as to drive the head motor 52 to thereby move the ink-jet heads 2 downward into the printing position.

When ink is initially introduced into the heads 2 and when a purge is performed, the maintenance unit movement controller 118 controls a motor driver 127 so as to drive the tray motor 92 thereby moving the tray 71 from the standby position to the maintenance position. After a purge is completed, the maintenance unit movement controller 118 controls the motor driver 127 so as to drive the tray motor 92 thereby horizontally moving the tray 71 from the maintenance position to the standby position. When a capping is performed, the maintenance unit movement controller 118 controls the motor driver 127 so as to drive the tray motor 92 thereby horizontally moving the trays 71 and 75 from the standby position to the capping position. When print data are received from the PC 100, the maintenance unit movement controller 118 controls the motor driver 127 so as to drive the tray motor 92 thereby horizontally moving the trays 71 and 75 from the capping position to the standby position.

The wiper swing controller 119 controls a motor driver 126 so as to drive a wiper motor 140 thereby bringing the wiper 72 into any one of the first position, the second position, and the third position.

With reference to FIGS. 5A to 6C, a description will be given to how the heads 2 and the maintenance unit 70 operate when ink is initially introduced into the heads 2 and when the maintenance controller 113 (see FIG. 4) receives a maintenance command from the PC 100.

First, the head movement controller 117 controls the motor driver 125 so as to drive the two head motors 52 in synchronization thereby moving the ink-jet heads 2 upward from the printing position. When the ink-jet heads 2 reach a first raised position as shown in FIG. 5A, the head movement controller 117 controls the motor driver 125 so as to stop driving of the head motor 52. The first raised position is a position which brings the ejection faces 3*a* and the bottom face of the frame 4 to such a level that, while the maintenance unit 70 is moving from the standby position to the maintenance position, members of the maintenance unit 70 such as the wiper 72 and the caps 76 do not come into contact with the ejection faces 3*a* and the bottom face of the frame 4.

Then, the maintenance movement controller 118 controls the motor driver 127 so as to drive the tray motor 92 thereby moving the tray 71, which is disengaged from the tray 75, along the arrow-D direction in FIG. 3 from the standby position to the maintenance position shown in FIG. 5A. When the tray 71 reaches the maintenance position, the maintenance movement controller 118 controls the motor driver 127 so as to stop driving of the tray motor 92. At this time, in a plan view, a left end of the tray 71 in FIG. 5A overlaps a right end of the waste ink tray 77. Both of the wiper 72 and the ink receiving member 73 are at a position not opposed to the head main bodies 3*a* with respect to the vertical direction. The wiper 72 takes the first state where the wiper extends in the vertical direction when viewed in the sub scanning direction.

Then, the head movement controller 117 controls the motor driver 125 so as to drive the two head motor 52 in synchronization thereby moving the ink-jet heads 2 downward from the first raised position shown in FIG. 5A. As the heads 2 is thus moved, the bottom face of the frame 4 and the upper faces of the protrusions 79 are brought into contact with each other. Then, the frame 4 further goes down against biasing force of the spring 78, so that along with contraction of the spring 78 the protrusions 79 goes down together with the holder 73*b*, to reach a state shown in FIG. 5B. In the state shown in FIG. 5B, the spring 78 is contracted by approximately 0.5 mm to 1 mm, and the protrusions 79 and the holder 73*b* are located lower than in a normal state where the spring 78 is not contracted, by an amount equal to the contraction of the spring 78, that is, by approximately 0.5 mm to 1 mm. A position of the heads 2 in this state will be referred to as a second raised position. In a period from when the bottom face of the frame 4 is brought into contact with the upper faces of the protrusions 79 to when the frame 4 further goes down until the heads 2 reach the second raised position, the distal ends of the thin plates 73*a* and the ejection faces 3*a* are kept at a constant distance of approximately 0.5 mm. When the ink-jet heads 2 reach the second raised position, the head movement controller 117 controls the motor driver 125 so as to stop driving of the head motor 52.

Then, the wiper swing controller 119 controls the motor driver 126 so as to drive the wiper motor 140 in such a manner that the wiper 72 swings into the second state where the wiper 72 is inclined away from the vertical direction toward the wiping direction (i.e., leftward in FIGS. 5A and 5B) when viewed in the sub scanning direction. At this time, the distal end of the wiper 72 is located above the ejection face 3*a* by a predetermined distance T1. That is, with respect to the vertical direction, the wiper 72 and the ink-jet heads 2 overlap each other by the distance T1. The distance T1 is smaller than an amount by which the wiper 72 and the ink-jet heads 2 overlap each other with respect to the vertical direction while the wiper 72 is in the first state as shown in FIG. 5A, that is, while the wiper 72 is extending in the vertical direction when viewed in the sub scanning direction. This is because the distal end of the wiper 72 shifts down due to inclination.

Then, the pump controller 116 controls the pump driver 124 so as to drive the pumps 134 thereby forcibly sending ink contained in the ink cartridges 16 to the head main bodies 3. Consequently, ink is forcibly ejected from the nozzles of the ink-jet heads 2. This is referred to as a first purge. By performing the first purge, clogging of nozzles or ink thickening within the nozzles can be removed, to recover ejection characteristics. Ink having ejected from the ejection faces 3*a* and dropped into the tray 71 moves leftward in FIG. 5B along the slope of the bottom face of the tray 71, and is received by the waste ink tray 77. The ink received by the waste ink tray 77 goes through the ink discharge hole 77*a* and flows into a waste ink reservoir (not shown). The pumps 134 driven in the first purge are kept driven until a first wiping which will be described later is completed. That is, ink ejection from the nozzles continues during a period from when the first purge is started to when the first wiping is completed.

Figure 5B:
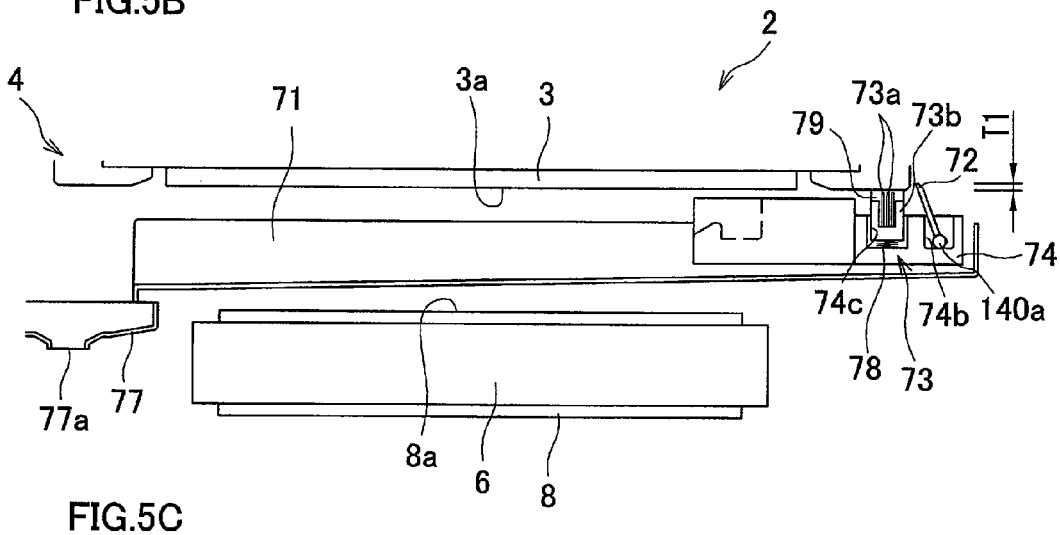
Figure 5C:
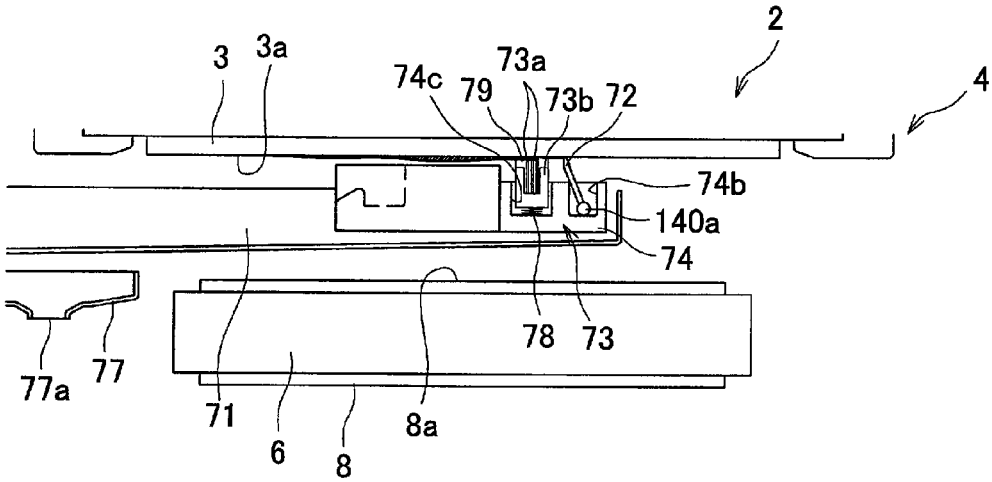

Then, the maintenance unit movement controller 118 controls the motor driver 127 so as to drive the tray motor 92 thus moving the tray 71 leftward in FIG. 5C. Along with movement of the tray 71, the ejection faces 3*a* are wiped. This is referred to as the first wiping. In the first wiping, first, the thin plates 3*a* of the ink receiving member 73 receives ink adhering to the ejection faces 3*a* not by coming into contact with the ejection faces 3*a* but by the capillary force. Then, the wiper 72 moves along the ejection faces 3*a* while being in contact with the ejection faces 3*a*, thereby wiping off ink and the like left on the ejection faces 3*a*. At this time, the wiper 72 is inclined toward the wiping direction. Since a plate surface of the wiper 72 forms an obtuse angle with the ejection faces 3*a* existing in a proceeding direction of the wiper 72, the wiping is performed in such a manner that deposits on the ejection faces 3*a* such as ink, paper dust, ink containing paper dust, and the like are scraped off.

When the wiper 72 reaches a position (i.e., a left end in FIG. 5C) which is not opposed to the ejection face 3*a* and the frame 4 with respect to the vertical direction, the maintenance movement controller 118 controls the motor driver 127 so as to stop driving of the tray motor 92 and at the same time the pump controller 116 controls the pump driver 124 so as to stop driving of the pump 134. As a consequence, both of the first purge and the first wiping are terminated. At this point of time, the ejection faces 3*a* are wet with a little ink which spreads thereon.

Then, the wiper swing controller 119 controls the motor driver 126 so as to drive the wiper motor 140 in such a manner that the wiper 72 swings into the first state where the wiper 72 extends along the vertical direction when viewed in the sub scanning direction.

Then, the head movement controller 117 controls the motor driver 125 so as to drive the two head motors 52 in synchronization thereby moving the ink-jet heads 2 upward from the second raised position shown in FIGS. 5B and 5C. When the ink-jet heads 2 reach the first raised position shown in FIG. 6A which is the same as shown in FIG. 5A, the head movement controller 117 controls the motor driver 125 so as to stop driving of the head motor 52.

Figure 6A:
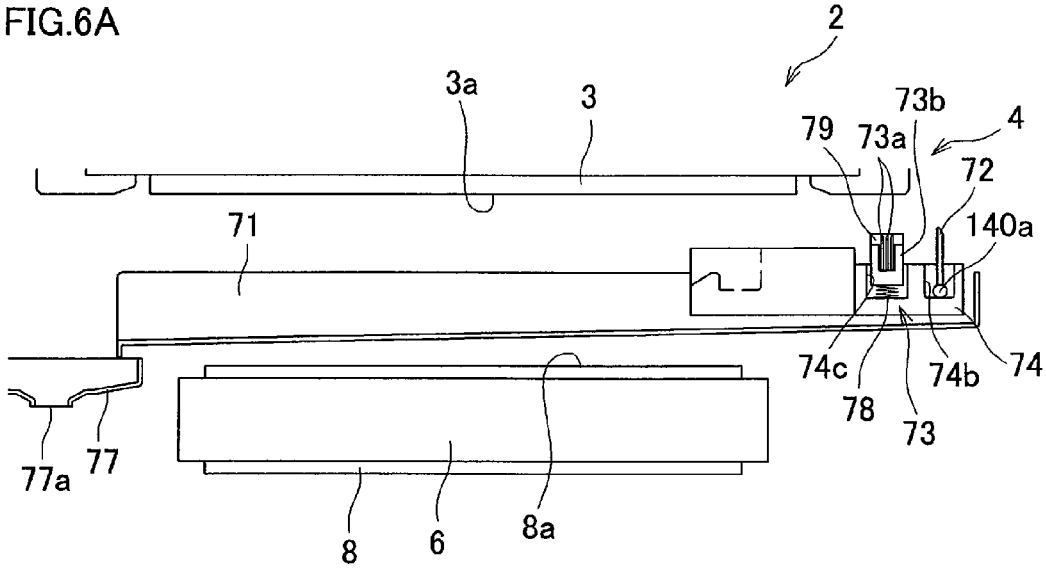
FIGS. 6A, 6B, and 6C are schematic side views showing a process of a second wiping.

Then, the maintenance unit movement controller 118 controls the motor driver 127 so as to drive the tray motor 92 thereby moving the tray 71 from left to right in FIG. 6A. When the tray 71 reaches the maintenance position shown in FIG. 6A, the maintenance movement controller 118 controls the motor driver 127 so as to stop driving of the tray motor 92. At this time, in a plan view, the left end of the tray 71 in FIG. 6A overlaps the right end of the waste ink tray 77 similarly to in FIG. 5A. In addition, the wiper 72 and the ink receiving member 73 are positioned in the same manner as in FIG. 5A.

Figure 6B:
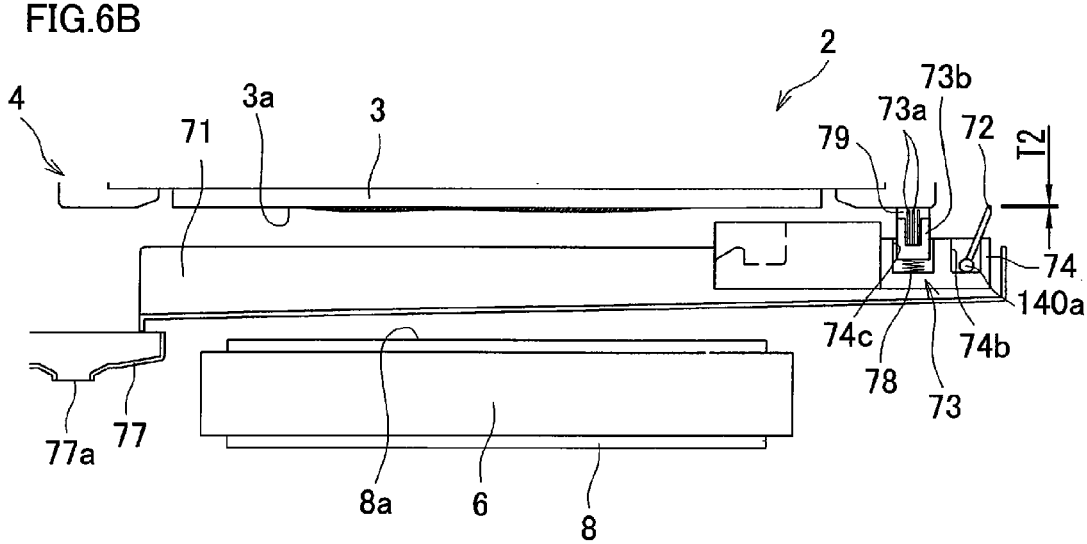

Then, the head movement controller 117 controls the motor driver 125 so as to drive the two head motor 52 in synchronization thereby moving the ink-jet heads 2 downward from the first raised position shown in FIG. 6A. At a point of time when the bottom face of the frame 4 and the upper faces of the protrusions 79 come into contact with each other as shown in FIG. 6B, the head movement controller 117 controls the motor driver 125 so as to stop driving of the head motor 52. A position of the heads 2 as shown in FIG. 6B will be referred to as a third raised position. At this time, the spring 78 is substantially not contracted, and the protrusions 79 and the holder 73*b* are at substantially the same level as they are at in the normal state where the spring 78 is not contracted. Accordingly, an amount by which the wiper 72 in the first state and the heads 2 overlap each other with respect to the vertical direction at this time is smaller than a distance by which they overlap each other before the first wiping, by an amount equal to the contraction of the spring 78 as described above in FIG. 5B, that is, by approximately 0.5 mm to 1 mm.

Since the holder 73*b* is biased by the spring 78 like this, a position of the heads 2 with respect to a height direction can be changed to the second raised position (see FIGS. 5B and 5C) and the third raised position (see FIGS. 6B and 6C) properly in accordance with contraction of the spring 78 while the bottom face of the frame 4 and the upper faces of the protrusions 79 are kept in contact with each other and also the distance between the distal ends of the thin plates 73*a* and the ejection faces 3*a* is kept at approximately 0.5 mm.

Then, the wiper swing controller 119 controls the motor driver 126 so as to drive the wiper motor 140 in such a manner that the wiper 72 swings into the third state where the wiper 72 is inclined away from the vertical direction toward the direction opposite to the wiping direction (i.e., rightward in FIGS. 6A and 6B) when viewed in the sub scanning direction. In the third state, the wiper 72 is inclined from the vertical direction at an angle larger than in the second state (see FIG. 5B), and the distal end of the wiper 72 is located above the ejection faces 3*a* by a predetermined distance T2. The distance T2 is shorter than the distant T1 in the second state. That is, with respect to the vertical direction, the wiper 72 and the ink-jet heads 2 overlap each other by the distance T2. The distance T2 is, like the distance T1, smaller than an amount by which the wiper 72 and the ink-jet heads 2 overlap each other with respect to the vertical direction while the wiper 72 is in the first state as shown in FIG. 6A, that is, while the wiper 72 is extending in the vertical direction when viewed in the sub scanning direction. However, as described above, the angle at which the wiper 72 in the third state as shown in FIG. 6B is inclined from the vertical direction is larger than the angle at which the wiper 72 in the second state as shown in FIG. 5B is inclined from the vertical direction. Therefore, an amount by which the wiper 72 and the heads 2 overlap each other with respect to the vertical direction is reduced more greatly by this swinging than by a swinging performed before the first wiping described above.

Then, the pump controller 116 controls the pump driver 124 so as to drive the pumps 134 thereby forcibly sending ink contained in the ink cartridges 16 to the head main bodies 3. Consequently, ink is forcibly ejected from the nozzles of the ink-jet heads 2. This is referred to as a second purge. By performing the second purge subsequent to the first purge, clogging of nozzles or ink thickening within the nozzles can more surely be removed, to further recover ejection characteristics. Ink having ejected from the ejection faces 3*a* in the second purge flows into the waste ink reservoir (not shown) through the same path as in the first purge.

After ink is ejected from the ink-jet heads 2 for a predetermined period of time in the second purge, the pump controller 116 control the pump driver 124 so as to stop driving of the pump 134. Like this, the second purge is terminated before a second wiping which will be described later is started. Therefore, an amount of ink ejected from the nozzles in the second purge may be larger than that in the first purge.

Figure 6C:
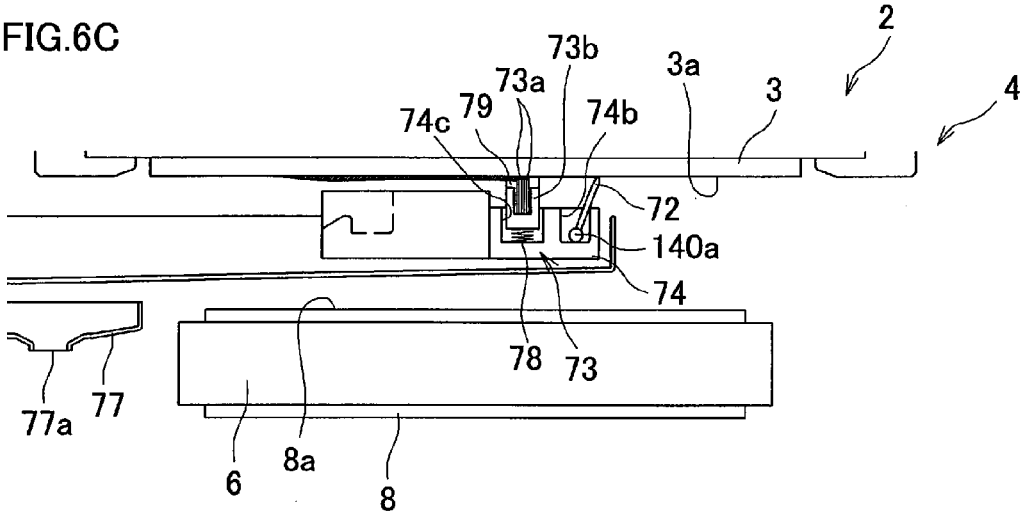

Then, the maintenance unit movement controller 118 controls the motor driver 127 so as to drive the tray motor 92 thus moving the tray 71 leftward in FIG. 6C. Along with movement of the tray 71, the ejection faces 3*a* are wiped. This is referred to as the second wiping. In the second wiping, like in the first wiping, first, the thin plates 3*a* of the ink receiving member 73 receives ink adhering to the ejection faces 3*a* not by coming into contact with the ejection faces 3*a* but by the capillary force. Then, the wiper 72 moves along the ejection faces 3*a* while being in contact with the ejection faces 3*a*, thereby wiping off ink and the like left on the ejection faces 3*a*.

When the maintenance unit 70 reaches the standby position shown in FIGS. 2 and 3, the maintenance movement controller 118 controls the motor driver 127 so as to stop driving of the tray motor 92. Then, the head movement controller 117 controls the motor driver 125 so as to drive the two head motors 52 in synchronization thereby moving the ink-jet heads 2 downward from the third raised position shown in FIG. 6C. When the ink-jet heads 2 reach the printing position, the head movement controller 117 controls the motor driver 125 so as to stop driving of the head motor 52. In this way, operations of the heads 2 and the maintenance unit 70, which are performed when ink is initially introduced into the heads 2 and when the maintenance controller 113 (see FIG. 4) receives a maintenance command from the PC 100, are completed.

Here, a description will be given to how respective parts of the printer 1 operate when the number counted by the counter 85 reaches a predetermined value.

First, the conveyance controller 112 controls the motor driver 122 so as to stop driving of the pick-up motor 132 thereby stopping rotation of the pickup roller 22. Then, the same operations are performed as when ink is initially introduced into the heads 2 and when the maintenance controller 113 (see FIG. 4) receives a maintenance command from the PC 100. After the operations are completed, a rest signal is transmitted from the controller 101 to the counter 85, and the number counted by the counter 85 is set to zero.

With reference to FIGS. 7A and 7B, a description will be given to how the maintenance unit 70 operates in a capping.

First, the head movement controller 117 controls the motor driver 125 so as to drive the two head motors 52 in synchronization thereby moving the ink-jet heads 2 upward from the printing position. When the ink-jet heads 2 reach the first raised position shown in FIG. 7A which is the same as shown in FIG. 5A, the head movement controller 117 controls the motor driver 125 so as to stop driving of the head motor 52.

Then, the maintenance unit movement controller 118 controls the motor driver 127 so as to drive the tray motor 92 thus moving the trays 71 and 75, which are coupled to each other, along the arrow-D direction in FIG. 3 from the standby position to the capping position shown in FIG. 7A. When the trays 71 and 75 reach the capping position, the maintenance movement controller 118 controls the motor driver 127 so as to stop driving of the tray motor 92. At this time, distal ends of the caps 76 are located above the distal end of the wiper 72 and the distal end of the ink receiving member 73.

Then, the head movement controller 117 controls the motor driver 125 so as to drive the two head motors 52 in synchronization thereby moving the ink-jet heads 2 downward from the first raised position shown in FIG. 7A. At a point of time when the ejection face 3*a* of the ink-jet head 2 and the distal end of the cap 76 come into contact with each other as shown in FIG. 7B, the head movement controller 117 controls the motor driver 125 so as to stop driving of the head motor 52. At this time, the spring 76*a* is substantially not contracted, and the distal end of the cap 76 is located above the distal end of the wiper 72 and the distal end of the ink receiving member 73 like in the FIG. 7A. Therefore, the wiper 72 and the ink receiving member 73 are not in contact with the ink-jet heads 2. A position of the heads 2 in this state will be referred to as a fourth raised position.

When the maintenance unit movement controller 118 receives print data from the PC 100 while the capping is performed as shown in FIG. 7B, the operations are performed by a procedure reversed to the above-described one. That is, the heads 2 are moved from the fourth raised position to the first raised position, and then the maintenance unit 70 is moved from the capping position shown in FIG. 7B to the standby position.

As thus far described above, in the printer 1 according to this embodiment, the first wiping is performed and the wiper 72 wipes the ejection faces 3*a* while ink is being forcibly ejected from the nozzles of the heads 2. This makes it difficult for deposits on the ejection faces 3*a* such as ink to enter the nozzles. As a result, characteristics of ink ejection from the nozzles are stabilized.

After the first wiping is performed, the second purge is performed and then the second wiping is further performed. The second wiping is performed while ink is not being ejected from the nozzles. Therefore, deposits on the ejection faces 3*a* are almost completely removed by the second wiping. As a result, characteristics of ink ejection from the nozzles are more stabilized.

The amount by which the wiper 72 and the heads 2 overlap each other with respect to the vertical direction is larger before the first wiping than before the second wiping, when the wiper 72 is not contact with the ejection face 3*a* before the movement of the tray 71 (see reference sign T1 of FIG. 5B and reference sign T2 of FIG. 6B). Accordingly, in the first wiping, as compared with in the second wiping, pressing force of the wiper 72 to the ejection faces 3*a* is larger and deposits on the ejection faces 3*a* are more surely removed.

During the first wiping, the wiper 72 is in the second state where the wiper 72 is inclined away from the vertical direction toward the wiping direction (see FIG. 5C), and the plate surface of the wiper 72 forms an obtuse angle with the ejection faces 3*a* existing in a proceeding direction of the wiper 72. Accordingly, deposits on the ejection faces 3*a* are scrapingly wiped off by the wiper 72, and therefore can more surely be removed.

During the second wiping, the wiper 72 is in the third state where the wiper 72 is inclined away from the vertical direction toward the direction opposite to the wiping direction (see FIG. 6C), and the plate surface of the wiper 72 forms an acute angle with the ejection faces 3*a* existing in a proceeding direction of the wiper 72. This prevents the wiper 72 from applying excessive force to the ejection faces 3*a*. Accordingly, damage to the ejection faces 3*a* can be suppressed.

During the first wiping, the wiper 72 takes the second state and is inclined toward the wiping direction. Therefore, pressing force of the wiper 72 to the ejection faces 3*a* is larger in the first wiping than in the second wiping. In the first wiping, however, ink is continuously ejected from the nozzles so that the wiper 72 moves on the ejection faces 3*a* in a slipping manner. Therefore, the ejection faces 3*a* are hardly damaged by the wiper 72.

As the number of printed papers increases, removal of deposits on the ejection faces 3*a* becomes more difficult. However, maintenance of the heads 2, which more specifically is a series of operations including the first purge, the first wiping, the second purge, and the second wiping, is performed when a predetermined number of papers have been printed. Accordingly, deposits on the ejection faces 3*a* can be removed effectively, and ink ejection characteristics can be kept stable over a long period of time.

When, for example, a user visually observes a failure of recording and operates the PC 100, a maintenance command is transmitted from the PC 100 to the maintenance controller 113, and the first wiping is performed in accordance with the command. Like this, taking not only the number of printed papers but also player's thought into consideration, ink ejection characteristics can more surely be stabilized.

Instead of the ink cartridge 16, a cleaning fluid cartridge (not shown) in which cleaning fluid is stored can be mounted on the cartridge mounting 17. When, for example, many foreign materials are adhering to the ejection face 3*a* or when thickened ink cannot be ejected from the nozzles, the ink-cartridge 16 is dismounted from the cartridge mounting 17 and the cleaning fluid cartridge is mounted on the cartridge mounting 17, and then the above-described purges and wipings are performed so that deposits on the ejection face 3*a* can be removed effectively and also ink passages within the head 2 can be cleaned.

Ink ejection performed in the purge is not splashing ink from the nozzles but oozing ink from the nozzles. Therefore, even though the first purge is performed during the first wiping, ink hardly drops onto the ejection face 8*a*. In addition, since the first wiping takes a relatively short time, ink is less likely to drop onto the ejection face 8*a*.

Since the guide unit 59 is provided, the ejection faces 3*a* are prevented from being inclined relative to the conveyor face 8*a* while the frame 4 and the ink-jet heads 2 are moving in the vertical direction. Thus, the ejection faces 3*a* are always kept parallel to the conveyor face 8*a*. As a result, accuracy of ink landing on a paper during a printing can be kept good.

In the above-described embodiment, the angle at which the wiper 72 in the third state as shown in FIG. 6B is inclined from the vertical direction is larger than the angle at which the wiper 72 in the second state as shown in FIG. 5B is inclined from the vertical direction. However, the angle in the second state and the angle in the third state may be the same.

In the first and second wipings, the wiper 72 may be inclined from the vertical direction at various angles.

In the above-described embodiment, after the first wiping is completed and before the heads 2 are moved from the second raised position to the first raised position, the wiper 72 is brought into the first state and then the third state to perform the second purge and the second wiping. However, this is not limitative. Bringing the wiper 72 into the first state may be omitted. In such a case, a time required for the maintenance is shortened.

During the second wiping, the wiper 72 may be in the first state, that is, the wiper 72 may extend in the vertical direction. In the above-described embodiment, a position of the heads 2 in the first wiping, that is, the second raised position, is lower than a position of the heads 2 in the second wiping, that is, the third raised position. Accordingly, even when the wiper 72 is in the first state during the second wiping, the wiper 72 is prevented from applying excessive force to the ejection faces 3*a* and accordingly damage to the ejection faces 3*a* can be suppressed, by reducing the amount by which the wiper 72 and heads 2 overlap each other with respect to the vertical direction before the second wiping to smaller than the distance T1 before the first wiping.

The wiper 72 and the heads 2 may overlap each other with respect to the vertical direction by various amounts before the first wiping and before the second wiping. For example, the amount before the first wiping and the amount before the second wiping may be the same.

The swing mechanism which swings the wiper 72, such as the wiper motor 140 and the drive shaft 140*a*, may be omitted. In such a case, the first and second wipings are performed while the wiper 72 stays in any of the first state, the second state, and the third state.

The second purge may be omitted from the series of operations including the first purge, the first wiping, the second purge, and the second wiping. In such a case, the little ink which spreads on the ejection faces 3*a* at the time when the first wiping is completed is removed by the second wiping, and therefore no ink remains on the ejection faces 3*a*.

In a case where, for example, there is little deposit on the ejection faces 3*a* after the first wiping ends, the second wiping may be omitted from the series of operations including the first purge, the first wiping, the second purge, and the second wiping.

In the above-described embodiment, the wiper 72 and the ink receiving member 73 are provided as a member which performs a wiping. However, the ink receiving member 73 may be omitted.

The counter 85 may be omitted.

In the above-described embodiment, a position of the heads 2 during the first wiping, that is, the second raised position, is lower than a position of the heads 2 during the second wiping, that is, the third raised position. However, the heads 2 may be at the same level in both of the first wiping and the second wiping. In such a case, by reducing an inclination angle of the wiper 72 relative to the vertical direction before the first wiping to smaller than the inclination angle before the second wiping as in the above-described embodiment, the amount by which the wiper 72 and the head 2 overlap each other with respect to the vertical direction becomes larger before the first wiping than before the second wiping. As a result, pressing force of the wiper 72 to the ejection faces 3*a* becomes larger in the first wiping than in the second wiping, and foreign material adhering to the ejection faces 3*a* can surely be removed.

The present invention is applicable not only to line-type printers but also others such as serial-type printers. In addition, the present invention is applicable not only to color printers but also monochrome printers.

Applications of the present invention are not limited to ink-jet printers. The present invention is applicable to various liquid ejection apparatuses having head which eject arbitrary liquid other than ink, such as conductive pastes, organic luminescent materials, or optical plastics. The liquid ejection apparatuses may be, for example, an apparatus which forms a fine wiring pattern on a substrate by ejecting a conductive paste, an apparatus which forms a high-resolution display by ejecting an organic luminescent material on a substrate, an apparatus which forms a minute electronic device such as an optical waveguide by ejecting an optical plastic on a substrate, and the like.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid ejection apparatus comprising:

a head having an ejection face on which a plurality of ejection openings through which liquid is ejected are formed;

a wiper which wipes the ejection face;

a supplier which supplies liquid to the head so that liquid is ejected from the ejection openings;

a first movement mechanism which moves at least either one of the wiper and the head in a first direction which is perpendicular to the ejection face, so as to make the wiper and the head overlap each other with respect to the first direction;

a second movement mechanism which moves at least either one of the wiper and the head, so as to make the wiper move along the ejection face while being in contact with the ejection face; and a controller which controls the supplier to make liquid ejected from the ejection openings, wherein:

the controller controls the first movement mechanism to make at least either one of the wiper and the head move in the first direction, and thereafter controls the second movement mechanism to make the wiper perform a first wiping, in the first wiping, while liquid is ejected from the ejection openings, the wiper moves along the ejection face while being in contact with the ejection face;

the controller controls the second movement mechanism so as to make the wiper further perform a second wiping after the first wiping;

in the second wiping, the wiper moves along the ejection face while being in contact with the ejection face, after liquid is ejected from the ejection openings and while no liquid is being ejected from the ejection openings; and the controller controls the first movement mechanism in such a manner that an amount by which the wiper and the head overlap each other with respect to the first direction is larger before the first wiping than before the second wiping, when the wiper is not contact with the ejection face before the movement by means of the second movement mechanism.

2. The liquid ejection apparatus according to claim 1, further comprising a swing mechanism which swings the wiper so as to make the wiper selectively take at least any one of a first state where the wiper extends in the first direction, a second state where the wiper is inclined away from the first direction toward a direction of wiping of the wiper, and a third state where the wiper is inclined away from the first direction toward a direction opposite to the direction of wiping, wherein the controller controls the swing mechanism so as to make the wiper take the second state during the first wiping.

3. The liquid ejection apparatus according to claim 2, wherein the controller controls the swing mechanism so as to make the wiper take either one of the first and third states during the second wiping.

4. The liquid ejection apparatus according to claim 1, further comprising:

a mounting to which either one of an ink cartridge which stores ink therein and a cleaning fluid cartridge which stores cleaning fluid therein is mounted; and a passage through which liquid stored in either one of the ink cartridge and the cleaning fluid cartridge mounted to the mounting is supplied to the head.

5. The liquid ejection apparatus according to claim 1, wherein the controller controls the supplier to make liquid ejected in such a manner as to ooze out from the ejection openings.

6. The liquid ejection apparatus according to claim 1, wherein the first movement mechanism includes a guide which guides at least either one of the wiper and the head along the first direction.

* * * * *